United States Patent [19]

Kersting

[11] Patent Number: 4,717,339

[45] Date of Patent: Jan. 5, 1988

[54] CURING OVEN

[76] Inventor: Erik Kersting, 45 Cross Street, Unit 1, Guelph, Ontario N1E 2Z5, Canada

[21] Appl. No.: 13,202

[22] Filed: Feb. 6, 1987

Related U.S. Application Data

[63] Continuation of Ser. No. 796,970, Nov. 12, 1985, abandoned.

[51] Int. Cl.[4] ..... F27B 9/00; F27B 5/16; F27D 3/04

[52] U.S. Cl. ..... 432/125; 432/144; 432/145; 34/194

[58] Field of Search ..... 432/125, 126, 144, 145, 432/148, 185, 186; 34/189, 190, 194

[56] References Cited

U.S. PATENT DOCUMENTS

| | | | |
|---|---|---|---|
| 183,943 | 10/1876 | Jones | 432/125 |
| 206618 | 7/1878 | Rogers et al. | 34/189 X |
| 1,885,404 | 11/1932 | Bamberg et al. | 34/194 |
| 2,214,421 | 9/1940 | Kneass, Jr. | 432/125 |
| 2,459,040 | 1/1949 | Weller | 432/145 |
| 3,790,336 | 2/1974 | Brede et al. | 432/125 |
| 4,162,141 | 7/1979 | West | 432/144 |

*Primary Examiner*—Henry C. Yuen

[57] ABSTRACT

The present invention provides a high efficiency, non-polluting curing oven, having an internal curing chamber comprising forward and rearward regions, bottom located forward and rearward access openings to and from the forward and rearward regions, a plurality of trays for carrying material to be cured through the curing chamber, a conveyor for conveying the trays to and from the forward and rearward regions through the forward and rearward access openings, a tray moving system for lifting the trays upwardly through the forward region and for transferring the trays to and for lowering the trays downwardly through the rearward region, a burner providing heated gases in a combustion chamber above the curing chamber and a fan for blowing the heated gases downwardly into the curing chamber for curing of the material with the heated gases rising back upwardly, creating a negative pressure to draw a supply of fresh outside air into the curing chamber, through the bottom located access openings.

1 Claim, 13 Drawing Figures

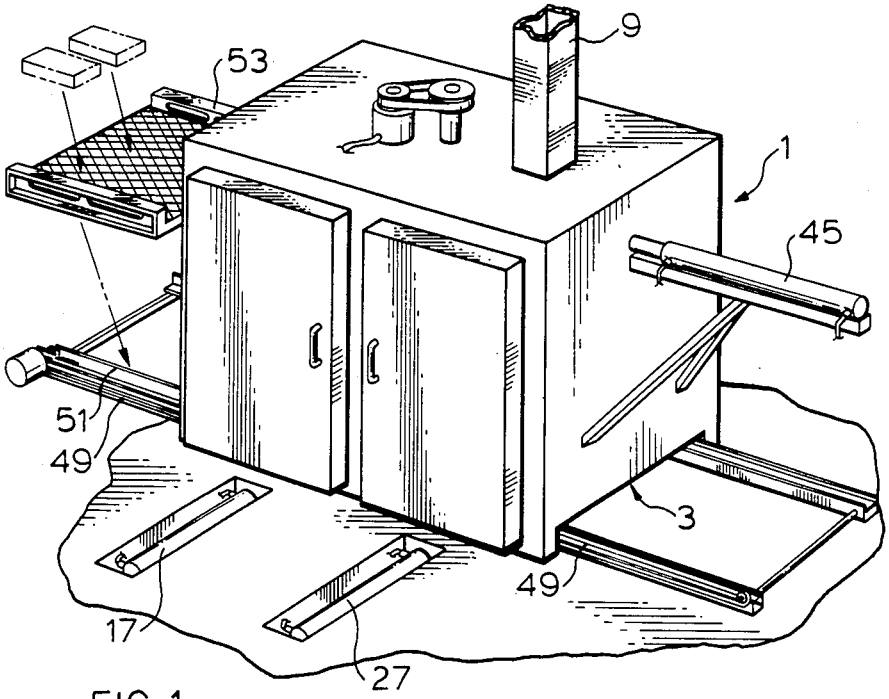
FIG. 1.
FIG. 2.
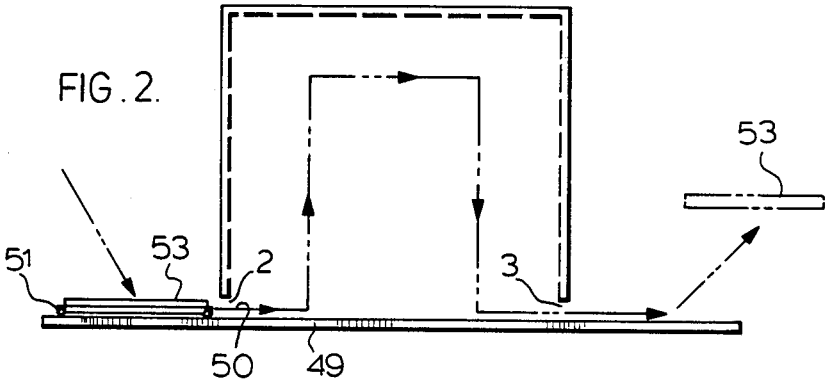
FIG. 3.
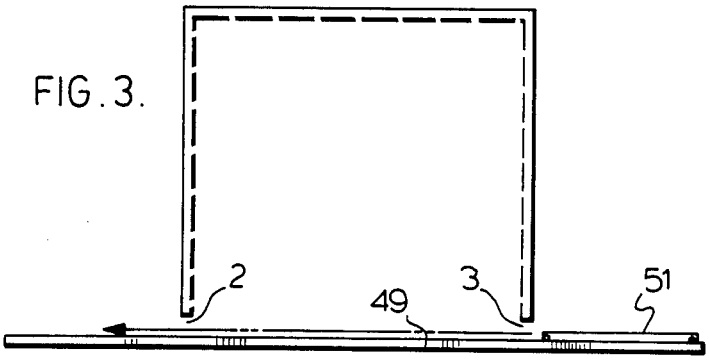

FIG.5.
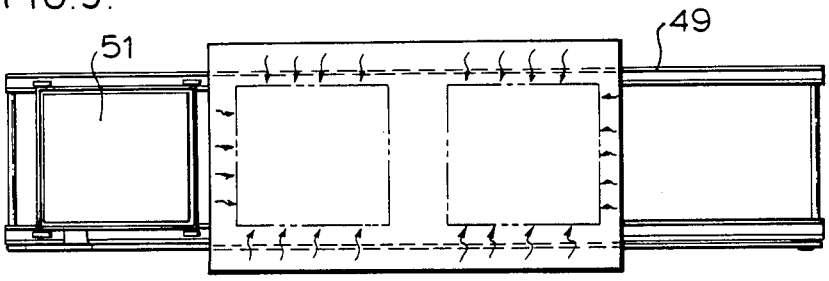
FIG.6.
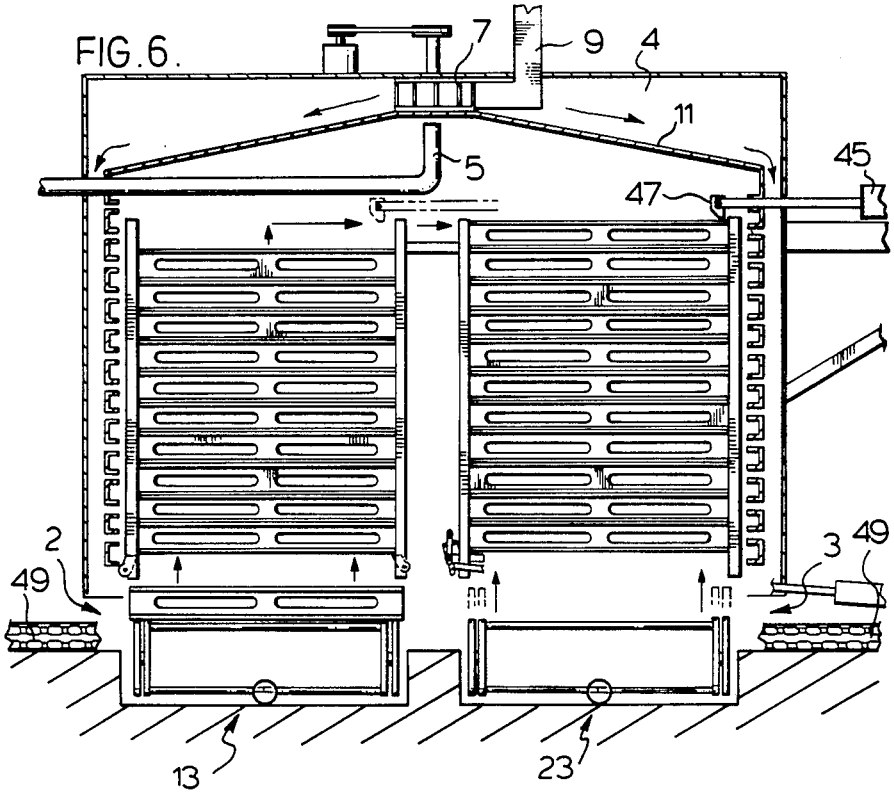
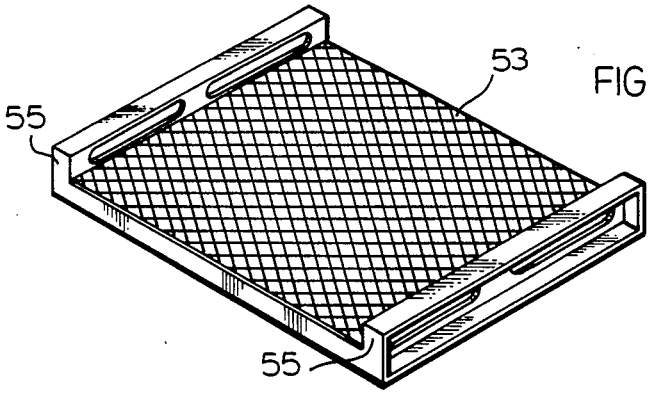
FIG. 7.

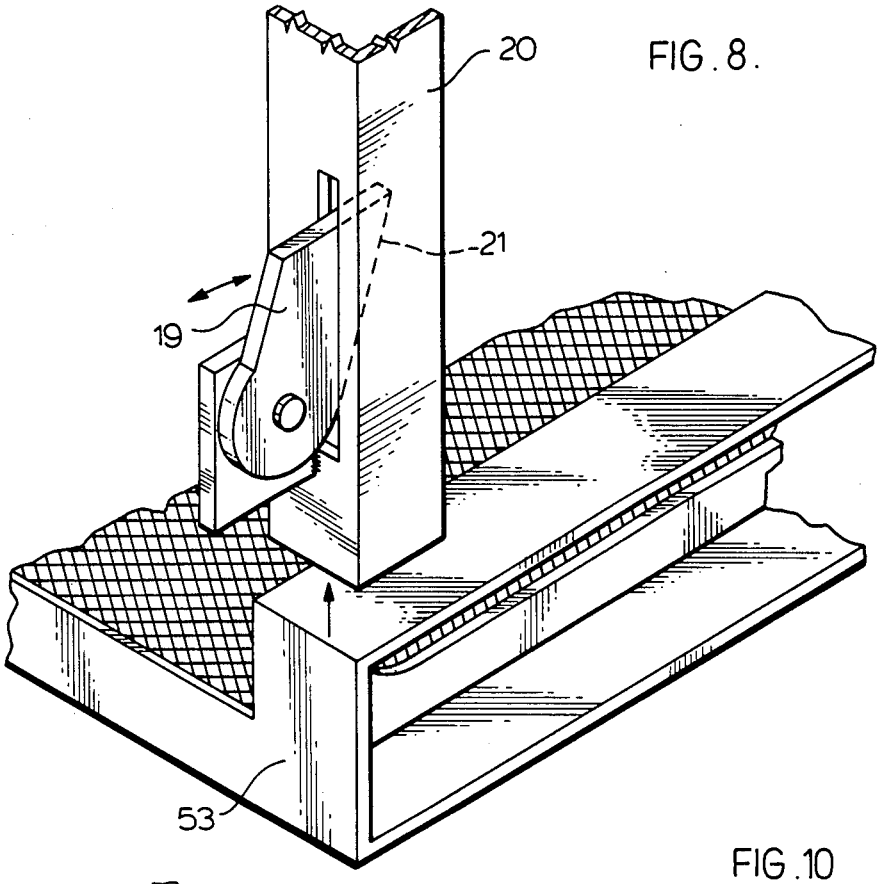
FIG. 8.
FIG. 9.
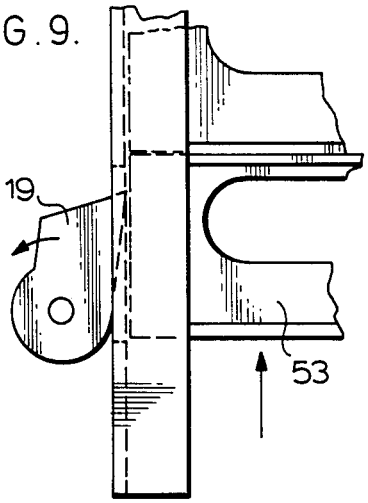
FIG. 10
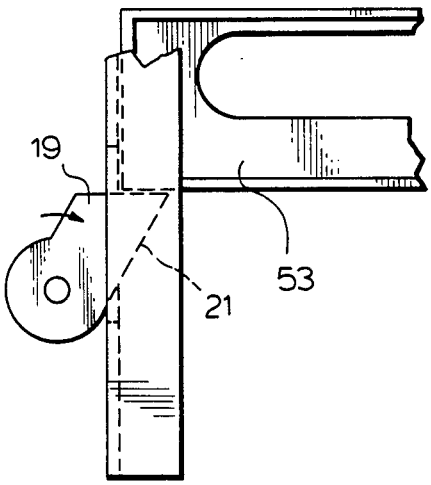

CURING OVEN

This is a continuation of application Ser. No. 796,970 filed Nov. 12, 1985, now abandoned.

FIELD OF THE INVENTION

The present invention relates to a curing oven, divided into a combustion chamber and a curing chamber, separated from one another. The curing gases produced in the combustion chamber are diffused downwardly into the curing chamber, where they cure material carried on trays moved vertically, in a first upward and a second downward direction, through the curing oven.

BACKGROUND OF THE INVENTION

According to conventional practice, as typically found in tunnel and cross flow-type curing ovens, the oven construction comprises an elongated horizontally extending housing structure, having full size access doors for entering the oven to enable loading and unloading of material to be cured within the oven. These types of ovens are highly inefficient, and therefore extremely costly to operate. They occupy large amounts of floor space and allow the escape of much of the heat energy produced internally of the oven when the doors are opened, for loading and unloading purposes.

For the reasons given immediately above, as well as to prevent burning of the material due to the proximity of the burner relative to the material, it is generally not possible with a conventional curing oven, to maintain the burner operating at a high efficiency, high temperature. This problem is further heightened, due to the fact that the material must be physically loaded and unloaded from the oven, where it would be dangerous to the operator to maintain extremely high curing temperatures. Therefore, by operating the burner at a lower temperature, as required with conventional ovens, the curing time is obviously increased and the burner itself, by not being operated at high temperatures, is relatively inefficient and incapable of providing a pollutant-free exhaust.

SUMMARY OF THE PRESENT INVENTION

The present invention provides a curing oven, designed for high efficiency operation with reduced floor space requirements in comparison to prior art structures. More particularly, the curing oven of the present invention consists of an a housing enclosing an internal curing chamber, comprising forward and rearward regions, bottom located forward and rearward access openings to and from the forward and rearward regions respectively, a plurality of trays for carrying material to be cured through the curing chamber, conveyor means for carrying the trays to and from the forward and rearward regions through the forward and rearward access openings without requiring opening of the curing oven, a tray moving system for lifting the trays upwardly through the forward region and for transferring the trays to and for lowering the trays downwardly through the rearward region, a burner providing heated gases in a combustion chamber located above and isolated from the curing chamber, and fan means for blowing the heated gases downwardly into the curing chamber through diffusing means for curing of the material. The heated gases then rise back upwardly and create a negative pressure to draw a supply of fresh outside air into the curing oven through the bottom located access openings.

The curing oven of the present invention, including its vertically operating curing chamber, requires substantially less floor space then a conventional, horizontally extended curing oven. Furthermore, the use of a tray moving system, as described above, eliminates the requirement of having to open and physically load and unload the oven, and allows the curing oven of the present invention to be maintained at high operating temperatures for efficient curing purposes. Additionally, the isolation of the curing chamber from the combustion chamber enables the burner to operate at an extremely high and highly efficient burning temperature, which in turn results in an essentially pollution-free exhaust blown directly down to the curing chamber and which can be safely exhausted directly to atmosphere.

BRIEF DISCUSSION OF THE DRAWINGS

The above, as well as other features and advantages of the present invention will be described in greater detail according to the preferred embodiments of the present invention in which:

FIG. 1 is a perspective view looking down on a curing oven set up according to a preferred embodiment of the present invention;

FIGS. 2 is a side view showing schematically the travel path for trays through the curing oven of FIG. 1;

FIG. 3 is a view similar to FIG. 2 showing the travel path of the tray carrier or cart, through the curing oven;

FIG. 5 is a top plan view of the curing oven of FIG. 1;

FIG. 6 is a side sectional view of the curing oven of FIG. 1;

FIG. 7 is a perspective view of a tray from the curing oven set-up of FIG. 1;

FIG. 8 is an enlarged sectional view of the stack supporting arrangement in the forward region of the curing oven of FIG. 1;

FIGS. 9 and 10 are side views, showing the operation of the stack supporting arrangement of FIG. 8;

DETAILED DESCRIPTION ACCORDING TO THE PREFERRED EMBODIMENTS OF THE PRESENT INVENTION:

FIG. 1 shows the housing, generally indicated at 1, of the curing oven. This housing is substantially totally enclosed, other than at the forward and rearward accesses 2 and 3, located at the bottom of the housing, and at the exhaust stack 9, extending up from the top of the housing. Also provided to one side of the housing are a pair of full sized doors which allow entrance to the oven during down time for maintenance and cleaning purposes or the like; however, when the oven is in operation, these doors remain shut, and as stated above, the housing is essentially closed off, which substantially reduces the loss of heat energy and increases efficiency of the oven.

Figure 4:
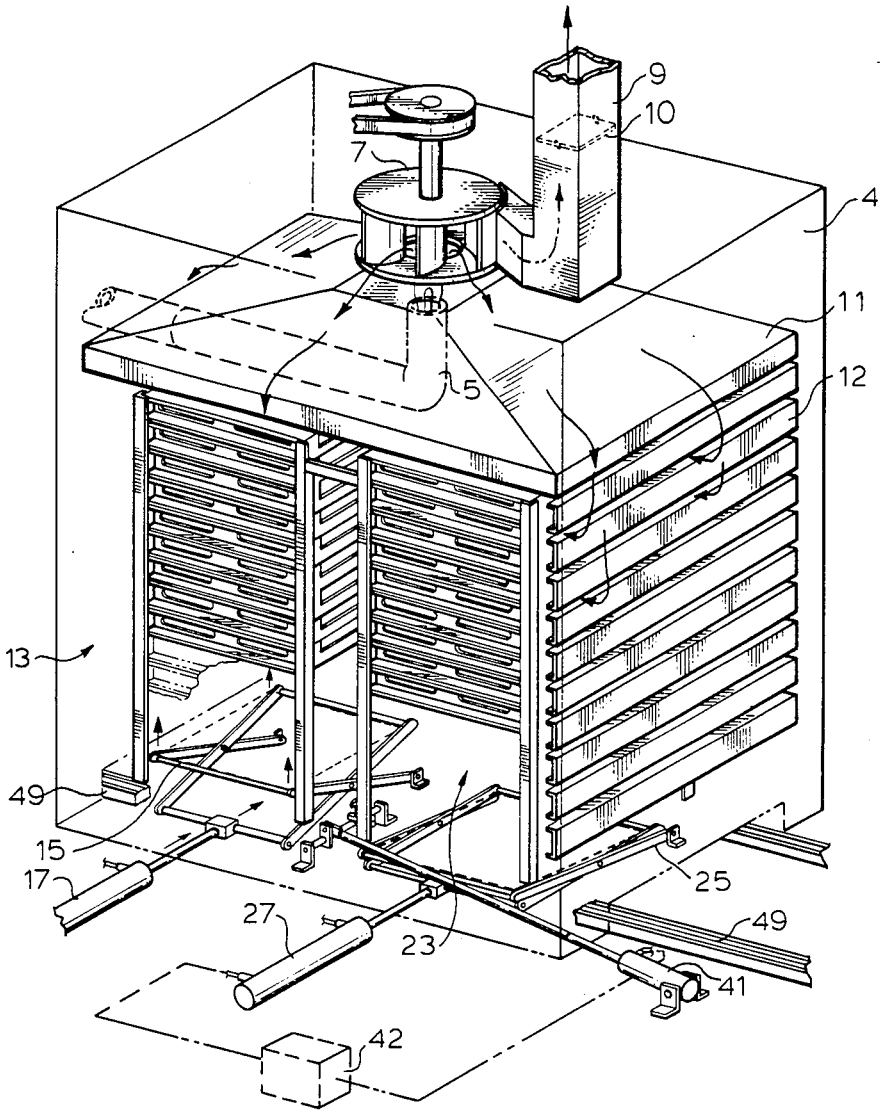
FIG. 4 is a perspective view showing in greater detail the internal construction of the curing oven of FIG. 1.

The internal construction of the oven is best shown in FIGS. 4 and 6 of the drawings. Here it will be seen that the oven is divided vertically into a combustion chamber 4, and a curing chamber comprising forward and rearward regions 13 and 23, respectively, of the curing chamber. The combustion chamber is isolated from the curing chamber by means of a heat shielding partition 11, below which are located a plurality of baffle-like diffusers 12.

A burner 5 is located within the combustion chamber and operates to provide heated gases to a motor-driven fan 7. The fan is set up to blow a good portion of the heated gases downwardly around shield 11, to the diffusers 12, which act to deflect the heated gases back into the curing chamber. In addition, some of the heated gases are blown by the fan upwardly through exhaust stack 9, which includes an internal damper plate 10, operated by the pressure created by the gases, to allow venting of the exhaust gases through the stack.

Through the provision of partition 11, the combustion and the curing chambers are effectively separated from one another, which allows burner 5 to operate at an extremely high, extremely efficient burning temperature, e.g., in the neighbourhood of about 1800 degrees fahrenheit. Without the presence of partition 11, heated gases given off at this temperature would immediately burn the types of materials, such as packing and insulation materials, and the like, and the phenolic fumes associated with these materials to be cured in the oven. However, again due to the presence of the partition and through the use of the deflecting diffusers 12, the heated gases are effectively reduced in temperature, as they enter the curing chamber and are deflected to substantially immerse the material for maximum curing purposes.

One of the prime benefits resulting in the high operating temperature of the burner, is that the gases given off at these temperatures are essentially pollution-free, i.e., any contaminants are completely burned at these temperatures, which allows both venting of the exhaust directly to atmosphere, and circulating of the gases directly to, without contaminating the material in the curing chamber.

The material to be cured is carried into the oven on a plurality of trays 53, the construction of which is best seen in FIGS. 1, 7 and 8 of the drawings. Each tray has an open, porous construction, so that materials supported on the tray, and immersed within the heated gases can be effectively cured from all sides, including from below, where the material is supported by the weave-like tray bed, as seen in FIG. 7.

These trays are moved individually into the curing oven, through the forward access 2, on an open framed cart 51, riding along a chain conveyor 49, extending completely through the curing oven and exiting at the rear access 3, as seen in FIG. 3. The open frame construction of the cart is designed to provide peripheral support of the individual trays, while leaving the centre area of each tray exposed for access to stacking and destacking means, to be described later in detail.

Again, as a feature lending to the efficiency of the curing oven, and due to the vertical stacking arrangement, it is to be noted that only a single tray-carrying cart is required to both drop trays off to and pick the trays up from, the curing oven, as will also be described further in greater detail.

Returning again to FIGS. 4 and 6, the forward region 13, and the rearward region 23, are loaded with a plurality of trays, stacked relative to one another. The trays individually enter the forward region where they are moved upwardly in an ascending stack, with the uppermost tray then being transferred across to the rearward region where the trays are moved downwardly in a descending stack. During the time that it takes to move upwardly from the lowermost position on the ascending stack and then return downwardly to the lowermost position on the descending stack, each tray is being subjected to the curing gases blown downwardly from the combustion into the curing chamber. The diffusers which are positioned over substantially the entire height of the curing chamber, guide the gases inwardly to the trays, where the material is totally surrounded from all sides, by the gases. The heated gases, after being blown downwardly into the curing chamber, have a tendency, due to natural convection properties, to rise back upwardly, adding further to the curing effect. At the same time, the rising of the heated gases causes a negative pressure forming a static chamber within the curing chamber, resulting in self-induced intake of fresh air through the forward and rearward access openings at the bottom of the housing. This intake of fresh air is drawn upwardly to provide an air supply for continued operation of the burner and the recirculating of heated gases back down into the curing chamber. Again, the efficiency of this set up is to be noted where no separate fans, or the like, are required for drawing in the fresh air to be supplied to the burner, but rather the system takes advantage of natural air pressure differentials set up as the heated gases rise within the curing chamber. Also because the oven remains closed at all times, and is well insulated, the operator can safely and comfortably, work in the immediate vicinity of the oven.

FIG. 5 shows the deflection pattern of the heated gases as they are forced downwardly into the curing chamber from the combustion chamber. Here it will be seen that the diffusers are set up to deflect or direct the heated gases, as shown by the arrows in the figure, from the front and to the sides of the trays in the ascending stack and from the rear and to the sides of the trays in the descending stack. Accordingly, by the time the trays have travelled up the ascending stack and then returned back down the descending stack, the material in the trays has been completely surrounded by the curing gases. Furthermore, the rising gases have a tendency to flow upwardly through the central region of the curing chamber, where they are once again effective for curing of the material.

In order to effectively load the trays within the curing oven, they are placed individually on cart 51, which travels along the chain-like conveyor 49, as seen in FIG. 5. The cart then moves into the curing oven through the forward access 2, and as it does so, trips a limit switch 50, as seen in FIG. 2. This sets off a timed sequence for the tray moving system within the oven, which operates as follows:

The cart after tripping switch 50 moves interiorly of the curing oven to sit immediately over tray lifter 15, as shown in FIG. 6. The tray lifter itself comprises a scissor lift table 15, provided with a table top, shown in phantom lines in the drawings. The scissor lift rises upwardly directly through the cart, which as earlier described, has an open frame construction, to permit this upward movement of the scissor lift which lifts the tray upwardly to a stack supporting arrangement. At the same time, the tray at the top of the stack in the forward region is pulled across to the uppermost position in the stack in the rearward region of the oven where the trays are then moved individually downwardly through the curing chamber. This up, across and down flow path, as seen in FIG. 3 of the drawings, ensures that each of the trays remains in the oven for a relatively extended period of time for complete and through curing of the material without actually having to make the oven itself of a substantially extended length, as is the case in the typical horizontally extending oven.

It is to be appreciated that in the event that further capacity for receiving additional trays is required, the oven can easily be set up to include additional stackers and destackers identical to those described above, i.e. the oven could well operate including a first stacker, a first destacker, a second stacker, and a second destacker, etcetera, again without substantially increasing the overall length of the curing oven.

Returning again to the actual stacking operation, FIGS. 8 through 10 show, in detail, the stack supporting arrangement at the forward region of the oven. This stack supporting arrangement comprises a pivotal latch or catch 19, which is weighted to normally extend through frame guide 20, which guides the stacking alignment of the trays as they are pushed upwardly by the scissor table. However, latch 19 includes a camming surface 21, over which the trays ride, as they are lifted upwardly by the scissor table, to push the catch out of the way, and then clear the trays upwardly over the catch. As soon as each of the trays has cleared over the catch, the catch then falls back to its normal stack supporting position beneath the lower edge of the tray to take up the weight of the stack, and allow the scissor table to return back to its tray pick-up position. This in turn allows cart 51, which is now empty, to move over to the second, or descending stack of trays, in the rearward region of the curing chamber, where the cart lines up with a second scissor lift table 25, again seen in FIG. 4 of the drawings.

Returning again to FIG. 6, once the vertical stack in the forward region of the oven has been completely filled, the uppermost of the trays is drawn across to the uppermost position in the descending stack of trays. This operation is effected by means of a piston 45, having a tray gripping hook 47 at its outer end for pulling the trays from one stack to the other. The timing for the operation of piston 45 is controlled through limit switch 50, which is tripped by cart 51, as earlier described.

Figure 11:
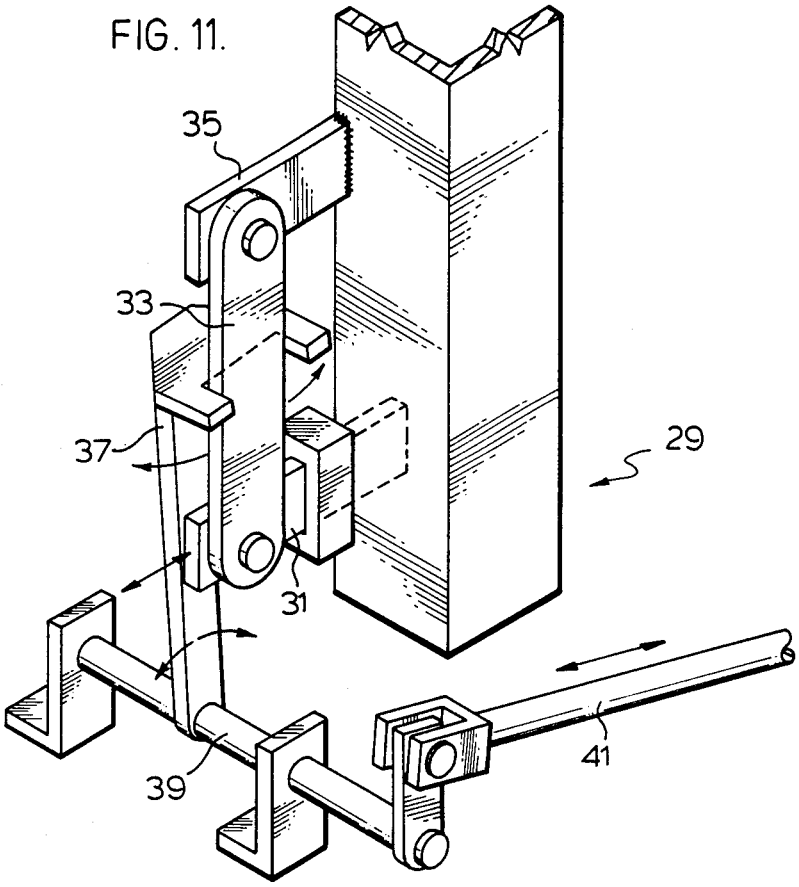
FIG. 11 is an enlarged, perspective view of the destacker arrangement, used in the rearward region of the curing oven of FIG. 1.

In order to provide space for the tray to move over to the descending stack, a destacker arrangement, generally indicated at 29, shown in FIG. 11, operates to release the lowermost tray and to allow the entire stack to drop downwardly by the height of one tray. Again, the timing of the operation for the destacker is controlled by tripping of limit switch 50 by cart 51.

Before describing the operation of the destacker, attention is drawn to FIGS. 7 and 8 of the drawings where it will be seen that each of the trays 53, includes upstanding side edge regions 55, which ensure that there is a gap between each of the beds of the trays in the stack. This gapping is important in performing the destacking as best described having reference to FIGS. 4 and 11 through 13. Here it will be seen that a pivotal linkage arrangement generally indicated at 29, for controlling the destacking, comprises piston 41 pivotally coupled to a rotating shaft 39 having an upwardly extending bracket portion 37 moveably fitted over and trapping a vertically extending bar 33. Bar 33 is, in turn, pivotally secured at its upper end 35 to a tray guide 36 and is further pivotally connected at its lower end to a generally horizontally extending slide bar 31.

Figure 12:
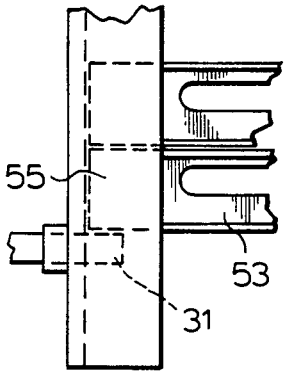
FIGS. 12 and 13 are side views showing the operation of the destacker of FIG. 11.
Figure 13:
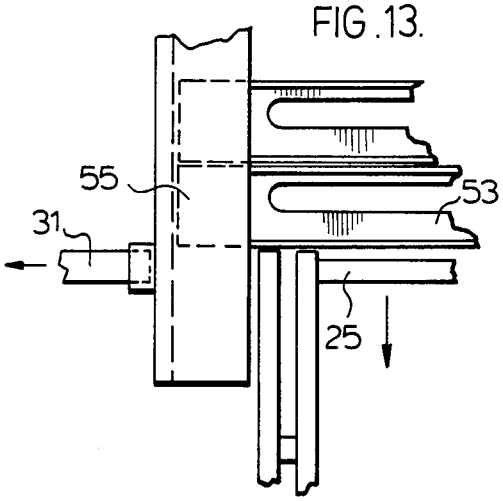

FIG. 12 shows slide bar 31 in the stack supporting position immediately beneath the bed of the lowermost tray in the descending stack at the rearward region of the oven. FIG. 13, on the other hand, shows the destacker, and in particular, slide bar 31, away from the stack supporting position, with the weight of the stack being supported by scissor table 25, which has been moved upwardly by the tripping of switch 50.

Scissor table 25, after having taken up the weight of the stack, begins to descend and to lower the overall stack, allowing clearance at the top of the stack for the tray which is pulled over from the ascending stack in the forward region of the curing chamber. As soon as the descending stack in the rearward region has been lowered by approximately the height of one tray, slide bar 31 slides back inwardly to again assume a stack supporting position, but this time immediately beneath the bed of the second lowermost tray, where it again takes up the weight of all of the trays thereabove. The fitting of the slide bar between the lowermost and second lowermost trays is allowed because of the open region, or gap between the trays, resulting from the provision of upstanding side ribs 55, on the trays, and providing a gap into which the slide bar slides to the stack supporting position. From here the scissor table continues downwardly, taking the lowermost tray with it to the open-framed cart while the remaining trays are supported in their stacked positions.

Again, the sequence for the operation of the destacker is timed in accordance with the other operations in the tray moving system such that while the rearward descending stack is moving downwardly to provide a tray space at its upper end, the ascending stack is moving upwardly and the uppermost tray in the ascending stack is drawn across to the rearward descending stack.

In terms of describing the actual operation of the destacker, piston 41 pushes on and rotates shaft 39, which in turn forces bracket portion 37 to push on vertical bar 33, causing this bar to pivot about its upper end and to retract bar 31 away from its stack supporting position. In order to return the slide bar to its stack supporting position, piston 41 operates in the opposite manner, i.e. piston 41 retracts to pull on shaft 39, again causing the shaft to rotate and moving bracket portion 37 to push, rather than to pull, on vertical bar 33 thereby sliding bar 31 back into its stack supporting position.

FIG. 4 shows a switch 42 for timed control of both of the pistons 27 and 41, which ensures that the rearward scissor table assumes its stack supporting position at the required time with retracting of slide bar 31 and to further assure that slide bar 31 takes up the stack supporting position as scissor table 25 drops downwardly with the lowermost tray.

As described above, scissor table 25 moves upwardly directly through open cart 51 which ensures that the trays returning individually back down with the scissor table, are in proper alignment for loading onto the cart. The cart upon receiving each tray, then continues through rearward access opening 3 out the back of the curing chamber, where each tray is unloaded by appropriate means such as a forklift, or the like. This allows the cart to return along its track, as shown in FIG. 3, for receiving further trays to be loaded in the curing chamber. Again, the efficiency of this set up requiring only a single cart for both loading and unloading of the oven should be noted and it should further be noted that all of this is accomplished without having to open any doors, or the like, to the oven, which would otherwise allow the escape of heat energy.

As clearly described above, the present invention is extremely efficient in ways additional to the saving of heat energy. For example, the curing oven of the present invention although relatively small and requiring limited floor space, has a high capacity curing chamber for receiving a large number of trays as the result of its vertical stacking and destacking operation. Furthermore, the isolation of the burner from the curing chamber allows it to be operated at much higher temperatures than that of conventional ovens, again resulting in increased efficiency for complete combustion and a non-polluting exhaust from the burner.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege claimed are defined as follows:

1. A curing oven having a housing enclosing an internal curing chamber comprising forward and rearward regions with bottom located forward and rearward access openings to and from said forward and rearward regions, a burner providing heated gases in a combustion region located above and isolated from said curing chamber by a heat shielding partition with deflectors therearound for deflecting and diffusing the heated gases from said burner downwardly into said curing chamber, said burner operating at a temperature sufficiently hot to provide a substantially non-poluting exhaust directly to atmosphere, fan means for blowing the heated gases downwardly into said curing chamber for curing of the material with the heated gases rising back upwardly and creating a negative pressure to draw a supply of fresh outside air into said curing oven through said bottom located access openings, a plurality of trays for carrying the material through said curing chamber, said trays being supported in side by side first and second vertical stacks in said forward and rearward regions and including a tray moving system comprising a first scissor lift for lifting said trays individually onto a cam operated pivotal catch weighted to normally assume a first stack supporting position relieving load on and freeing said first scissor lift to lower and receive further trays to be lifted to said pivotal catch, means for transfering the trays from atop the first vertical stack in said forward region to atop the second vertical stack in said rearward region, a second scissor lift for lowering the trays individually in the second vertical stack onto a slide bar immediately beneath the lowermost tray to assume a second stack supporting position with said slide bar being operated by a pivotal linkage which is in turn controlled by a piston to slide said slide bar in and out of the second stack supporting position.

* * * * *